US005299587A

United States Patent [19]

Randall et al.

[11] Patent Number: 5,299,587

[45] Date of Patent: Apr. 5, 1994

[54] ROTATING AND RECIPROCATING IMMERSION CLEANING APPARATUS AND METHOD

[75] Inventors: Frederick Randall, Montclair; Albert J. Raven, III, Morganville, both of N.J.

[73] Assignee: Randall Manufacturing Company, Inc., Hillside, N.J.

[21] Appl. No.: 999,013

[22] Filed: Dec. 31, 1992

[51] Int. Cl.[5] ..... B08B 3/04

[52] U.S. Cl. ..... 134/111; 134/135; 134/159; 134/161; 134/165; 134/143

[58] Field of Search ..... 134/135, 143, 159, 157, 134/161, 164, 165; 68/132, 140, 210

[56] References Cited

U.S. PATENT DOCUMENTS

| | | | |
|---|---|---|---|
| 1,312,414 | 8/1919 | Monte | 134/161 |
| 1,567,992 | 12/1925 | Dyktor et al. | 134/161 |
| 2,411,179 | 11/1946 | Swensen et al. | 134/161 |
| 2,619,781 | 12/1952 | Bührer | 134/161 |
| 2,663,304 | 12/1953 | Logan | 134/161 |
| 2,824,029 | 2/1958 | Zinty | 134/161 |
| 3,615,824 | 10/1971 | Hittel et al. | 134/161 |
| 3,910,297 | 10/1975 | Pinkham | 134/161 |
| 5,186,193 | 2/1993 | Gullberg et al. | 134/135 |

FOREIGN PATENT DOCUMENTS

| | | | |
|---|---|---|---|
| 1289688 | 2/1962 | France | 134/161 |

*Primary Examiner*—Frankie L. Stinson
*Attorney, Agent, or Firm*—Arthur L. Plevy

[57] ABSTRACT

The present invention is an apparatus and method for immersing at least one contaminated part in a fluid, wherein the contaminated parts are moved through the fluid with both a rotational and reciprocal movement. The compound movement of the contaminated parts cause the parts to be repeatedly lifted from, and immersed within, the fluid, thereby improving the interaction of the fluid on all surfaces of the contaminated parts regardless to the shape or orientation of the contaminated parts.

19 Claims, 6 Drawing Sheets

ROTATING AND RECIPROCATING IMMERSION CLEANING APPARATUS AND METHOD

FIELD OF THE INVENTION

The present invention relates to a cleaning apparatus and method used in cleaning contaminated parts by repeatedly immersing the contaminated parts into a cleaning solution, and more particularly, to such cleaning apparatus wherein the contaminated parts are reciprocated into, and out of, the cleaning solution, while simultaneously being rotated along a circular path.

BACKGROUND OF THE INVENTION

Immersion cleaning devices are widely used in many different industries to clean and/or chemically treat a variety of manufactured products. For instance, immersion cleaning devices are widely used in machine shops to clean dirt, grease and other contaminants from used parts that are in need of repair. Furthermore, immersion cleaning devices are also commonly used to clean newly manufactured parts after a machining operation, wherein the machining operation contaminates the parts with residual machining oils, machine chips or other debris.

Immersion cleaning devices operate by immersing contaminated parts into a cleaning solution. The contaminated parts and/or cleaning solution is then agitated to provide the needed cleaning action. The cleaning solution used within the immersion cleaning device is dependent upon what contaminant is to be removed from a particular object. Such solutions can be hydrocarbon based, however due to environmental concerns, water-base solutions used in conjunction with detergents are typically used.

In a manufacturing environment, where it is desirable to clean a large number of parts at one time, parts are conventionally grouped into batches. A batch of parts is then entered into the immersion cleaning device where all the parts in the batch are cleaned simultaneously. Since immersion cleaning devices are used to clean a large variety of objects, such devices conventionally come equipped with wire mesh baskets or containers. These containers are sized to fit properly within the immersion cleaning device. The containers are filled with the batch of parts to be cleaned and is used to confine the movement of the parts during the cleaning procedure. This also allows multiple containers to be filled with batches of parts in advance, so that the containers can be quickly loaded and unloaded into the immersion cleaning device. Consequently, the amount of downtime experienced by the immersion cleaning device is reduced and more parts can be cleaned in a given period of time.

There is a large variety of techniques for producing agitational movement within various prior art immersion cleaning devices. A common agitational movement is that of vertical reciprocation, wherein the contaminated parts are repeatedly cycled up and down within the cleaning solution. Such prior art devices are currently being manufactured and are exemplified by the immersion cleaners of Kleer-Flo Company of Eden Prarie Minn., Machine Model Nos. PW200, PW500, PW1000 and PW2000 which are being sold under the tradename POWERMASTER® part washers. Such immersion cleaners are also exemplified by the immersion cleaners of Man-Gill Chemical Company of Cleveland Ohio, Machine Model Nos. 3MALH, 4MALH and 5MALH sold under the tradename MAGNUS®. In such prior art immersion cleaning devices contaminated parts are placed upon a platform. The platform is then rapidly vertically reciprocated within the cleaning solution. The movement of the container of parts and the platform within the cleaning solution, agitates the cleaning solution thereby adding to the cleaning operation.

Using a purely vertical reciprocal movement is not highly effective in removing contaminants and debris from blind holes and other depressions that may exist on the surfaces of the parts being cleaned. For example, if machining chips were present in a blind hole on a part being cleaned, and the chips were not flushed out of the blind hole during the reciprocal movement, the chips may not be removed. To improve the agitation of parts within immersion cleaning devices, immersion cleaners have been developed that rotate the contaminated parts within the cleaning solution. The rotational movement of the parts repeatedly changes the orientation of the parts and increases the probability that contaminants and debris in blind holes will be removed. Such prior art devices are exemplified by the immersion cleaners of Bowden Industries Incorporated of Huntsville Ala., Machine Model Nos. RB-160 and RB-300, sold under the tradename LIQUID TURBO-CHARGER TM. Such prior art devices are further exemplified by U.S. Pat. No. 3,022,881 to Harper, et al, entitled AUTOMATIC CONVERSION IMMERSING MACHINE. In such prior art devices, the contaminated parts are retained within a rotating assembly. As such, the part containers must be loaded into, and removed from, the rotating assembly each time a batch of parts is processed. This results in a large amount of downtime for the immersion cleaner as it is loaded and unloaded, thereby reducing the capacity and efficiency of the immersion cleaner for any given period of time.

U.S. Pat. No. 3,006,351 to Grube, entitled ROTO DUNKER AND PROCESSING HOT TANK discloses an immersion cleaning device having a transportable rotating assembly in which various containers of parts can be placed. The prefilled rotating assembly can then be loaded into the immersion cleaning device in a single operation, rather than having to load several containers of parts into a stationary rotating assembly. Consequently, different rotating assemblies can be employed within the immersion cleaning device, thereby reducing the amount of time required in loading and unloading the immersion cleaner. Furthermore, the Grube patent discloses an agitation cycle that both rotates the part containers and reciprocally displaces the part containers. The use of a transportable rotating assembly allows the rotating assembly to be moved from one immersion cleaning machine to another without having to unload the part containers. However, in the Grube patent the rotating assembly is transported using a hoist apparatus which makes the transportation of the rotating assembly between separate machines a labor intensive and time consuming operation.

In many applications, the cleaning of manufactured parts is a process that has multiple steps. For instance, the parts to be cleaned may be presoaked in a degreasing bath, washed, rinsed and then dried. In immersion cleaning, it is impractical to empty and refill a single immersion cleaning machine with the different solutions needed for the various steps in the cleaning procedure. As such, parts are usually transferred from one machine to another, wherein each machine is dedicated to perform a separate cleaning procedure. Since the parts to be cleaned are held within wire mesh containers, it is typically these containers that are moved between the separate machines. In conventional immersion cleaning machines that use purely a vertical reciprocal movement, the transfer of part containers between machines is relatively simple. Roller conveyors can be placed between adjacent machines. The containers of parts can then be pushed along the roller conveyors from one machine to another.

Such simplistic transfer systems do not work on immersion cleaning machines that utilize a purely rotational agitating movement. In some prior art immersion cleaners, the part containers must be manually removed from the rotating frame, transferred to the second machine and reloaded into the rotating frame of the second machine. In other systems, such as that found in U.S. Pat. No. 3,022,881 to Harper et al., the rotating frame travels above separate immersion baths, selectively submersing the parts container into each bath. In either application, the mechanisms used to rotate the parts container within the cleaning solution are located above the parts container, and move in conjunction with the rotating parts container.

It is therefore a primary objective of the present invention to provide an immersion cleaning apparatus that cleans parts utilizing both a reciprocating and a rotational agitating movement and further provides a transfer system wherein the parts being cleaned can be efficiently transferred between separate machines.

It is further objective of the present invention to provide an immersion cleaning apparatus which operates to isolate the cleaning solution before, during and after the cleaning procedure, thereby reducing the loss of solution and the loss of heat from the solution by convection.

SUMMARY OF THE INVENTION

The present invention is an immersion cleaning apparatus and method for cleaning contaminated parts. Contaminated parts are placed within basket containers, which in turn are placed within receptacles on a pallet assembly. The receptacles are pivotably attached to the pallet assembly and are free to rotate around a common axis within the pallet assembly. A gear arrangement is coupled to the receptacles providing a means through which the receptacles can be rotated.

An elevator platform is disposed within a tank partially filled with cleaning solution that is being turbulently agitated. The pallet assembly is positionable upon the elevator platform. As such, the elevator platform can reciprocally move the pallet assembly up and down within the tank, and therefore in and out of the turbulent cleaning solution. A drive gear is disposed on the elevator platform, and is coupled to an electric motor which moves in unison with the elevator platform. The drive gear automatically engages the gear arrangement on the pallet assembly as the pallet assembly is positioned upon the elevator platform. As such, the drive gear drives the gear arrangement on the pallet assembly which rotates the receptacles within the pallet assembly.

The elevator platform lowers the pallet assembly into the cleaning solution. Once within the solution, the pallet assembly is rapidly cycled up and down, causing the parts to oscillate into and out of the cleaning solution. Simultaneously, the drive gear causes the receptacles within the pallet assembly to rotate. Consequently, the contaminated parts within the pallet assembly are being displaced with both a rotating action while vertically oscillating in and out of solution. This allows all the contaminated parts with blind holes or recessed areas to be cleaned more effectively by having the solution repeatedly fill and drain these areas. This is an improvement in the cleaning process used for removing oils and contamination from various stampings, screw machine parts and generally any hard to clean components. The complete system employs solution turbulent agitation of the cleaning (via pump injectors), platform oscillation, part rotation and gravity to fill and drain difficult to clean areas. All cleaning motions operate simultaneously or individually as required.

A unique sequenced cycle is provided to evacuate any surface film of oil away from the cleaning solution prior to the pallet assembly being raised out of the cleaning solution. The sequenced cycle consists of multiple cascading timers that control the various cycle times. After the wash cycle, where the parts have undergone immersion agitation and rotation, a dwell cycle is initiated where all agitation systems are made static and the parts are held at a position below the surface of the cleaning solution. This allows buoyant contaminants to gather at the surface of the cleaning solution. A surface sweep cycle is initiated wherein solution is pumped from an oil clarifying system into the tank, thereby flooding, overflowing and sweeping the surface contaminants into a large dam. The contaminated solution is then routed into the oil removal system for clarifying and recycling. When the sweep cycle is completed, the receptacles within the pallet assembly are again rotated. The cover of the tank then automatically opens and the elevator platform rises to the original transfer position. Once out of the cleaning solution, the pallet assembly can be automatically removed and replaced with a second pallet assembly, via a walking beam, overhead pusher or robot. Consequently, the downtime associated with loading and unloading the immersion cleaning apparatus is greatly reduced.

Additionally, since the drive means for rotating the receptacles of the pallet assembly are contained within the tank, the tank can be closed during the cleaning cycle. As such, loss of cleaning solution due to spillage and evaporation is reduced as is the loss of heat from the cleaning solution due to convection with the surrounding environment. This saves energy and improves safety compared to open cover rotators and/or processing baths. The cover is independent of the rotating mechanism and is electrically sequenced to close over the pallet assembly as the elevator platform descends into solution. The cover can be closed over any of the open tanks during non-operating or shutdown periods. Since the parts to be cleaned are held within the pallet assemblies, a pallitized system can be created where multiple pallet assemblies are processed down a line of tanks. Since the pallet assemblies automatically meshes with the drive gear in each tank as the pallet assembly is placed onto the elevator platform of that tank, the transfer of pallets can be made manually or automatically by simply moving the pallet assemblies from tank to tank along a roller conveyor.

The pallet assemblies do not have to be hoisted or in any way lifted and carried to the next processing tank. Furthermore, the system in manual transfer or automatic transfer modes is not dedicated to only processing articles loaded into pallet assemblies. The same elevator platforms can accept straight feed through baskets for single or multiple tank processing without modification to the system. Mixed batches can also be run together (i.e., part rotators and straight baskets) without special consideration.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention can be used in many different applications where it is desired to immerse objects in a solution, such as for chemical surface treatment, it is especially suitable for use in cleaning contaminants and debris from manufactured products. Accordingly, the present invention will be described in connection with a cleaning procedure for manufactured products.

Figure 1:
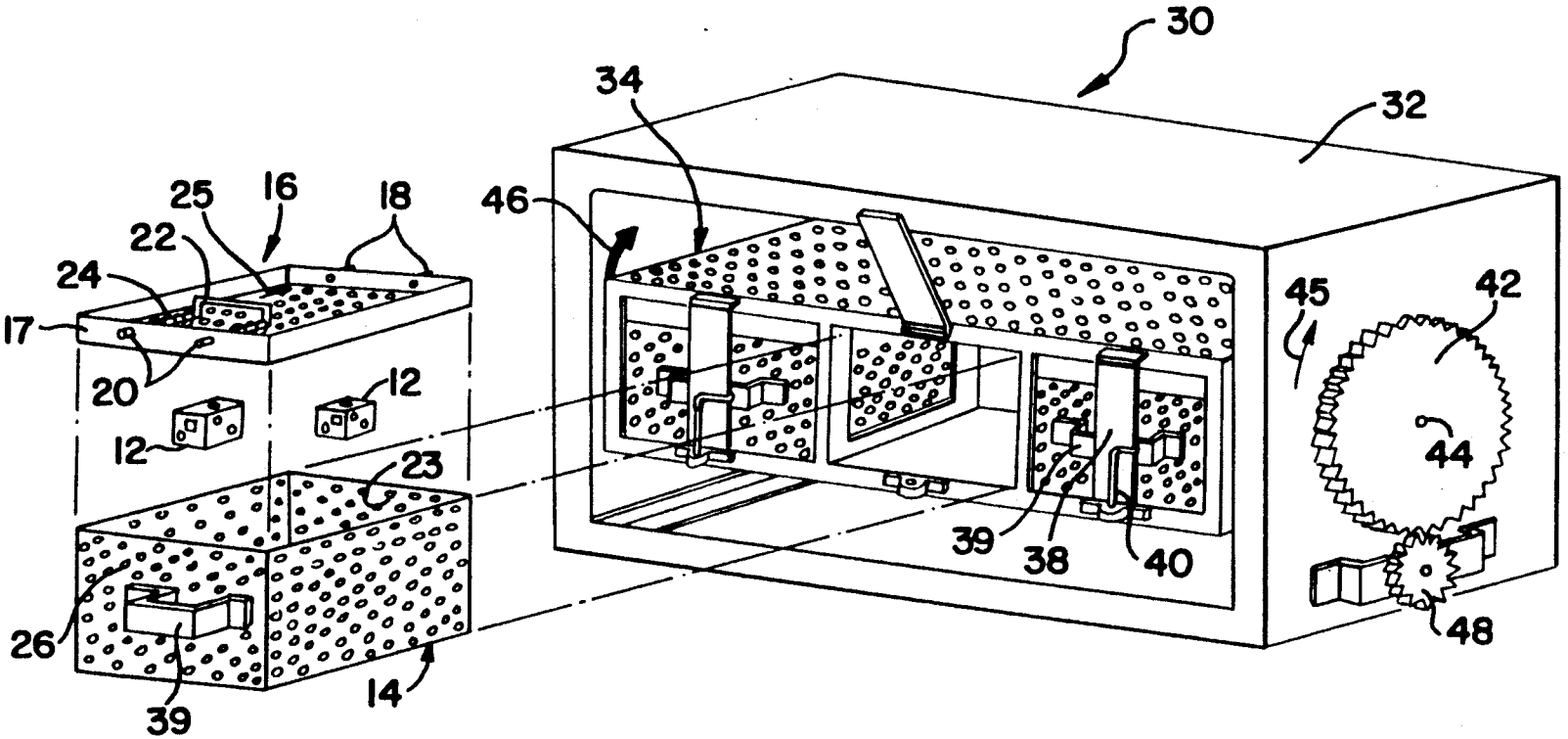
FIG. 1 is a perspective view of a pallet assembly constructed in accordance with one preferred embodiment of the present invention and shown in conjunction with a basket container filled with manufactured parts to facilitate consideration and discussion.

Referring to FIG. 1, manufactured parts 12, which are to be cleaned, are placed within a basket container 14. The basket container 14 is made of a perforated material that would allow liquid to contact the manufactured parts 12 within the basket container 14 when the basket container 14 immersed within a liquid. In the shown embodiment the basket container 14 is made of a metal, wherein a series of round holes are formed in the metal creating a repeating pattern of perforations. It is understood that the container may be constructed of any suitable material other than metal provided the material was inert in regard to the cleaning solution and was strong enough to contain the manufactured parts 12 without being damaged.

A frame-like cover 16 is positionable within the basket container 14. Stationary pegs 18 extend from one end of the cover 16. Retractable pegs 20 extend from another end of the cover 16 opposite the stationary pegs 18. The retractable pegs 20 are part of a handle assembly 22. The retractable pegs 20 are biased into a position extending beyond the end surface 17 of the cover 16 by means of springs 24 or other biasing elements. The retractable pegs 20 can be retracted to a point flush with the end surface 17 by the manipulation of the handle assembly 22 in a direction to oppose the bias of the springs 24, as is shown by arrow 25.

By retracting the retractable pegs 20 to a point flush with the end surface 17, the cover 16 can be passed into the basket container 14. The stationary pegs 18 are sized to fit into the perforations of the basket container 14. As such, the stationary pegs 18 can be passed into the perforations on the rear wall 23 of the basket container 14 at any point along the height of the rear wall 23. Similarly, by releasing the handle assembly 22, the retractable pins 20 will again extend beyond the end surface 17 of the cover 16 and will pass through the nearest perforations on the front wall 26 of the basket container 14. As such, the cover 16 can be positioned at any desired depth within the basket container 14. This allows the cover 16 to be positioned directly against the top of the manufactured parts 12 being held within the basket container 14. The juxtaposition of the manufactured parts 12 between the basket container 14 and the cover 16 prevents the manufactured parts 12 from moving around and damaging other parts as the basket container 14 is rotated in the manner which will be later explained.

Once the desired manufactured parts 12 are placed within the basket container 14 and the cover 16 is secured, the basket container 14 is placed within the pallet assembly 30. The pallet assembly 30 is comprised of an outer box frame 32 in which a rotating compartment 34 is positioned. In the shown embodiment, the rotating compartment 34 is a single shelf assembly capable of retaining three basket containers 14 side-by-side. It will be understood, however, that other configurations of the rotating compartment 34 may exist having multiple levels. The multiple levels can be symmetrically disposed about a common axis so as to be balanced when rotated about the axis. The basket containers 14 may be secured within the rotating compartment 34 in any conventional manner. In the shown embodiment, latches 38 are closed over the basket containers 14 and is secured by a latch key 40. The latches 38 contact the handles 39 on the basket containers 14, thereby preventing movement of basket container 14 back out of the rotating compartment 34. The movement of the basket containers 14 in the remaining directions is prevented by the structure of the rotating compartment 34 which confines the basket container 14 along all of its other surfaces. The material of the rotating compartment 34 is constructed so when the rotating compartment 34 is immersed in a solution, the solution can flow through both the rotating compartment 34 and the basket containers 14 to enable the manufactured parts 12 to be cleaned by the solution.

The rotating compartment 34 is pivotally attached within the box frame 32 so as to be rotatable around an axis within the box frame 32. The rotating compartment 34 is attached to a primary gear 42, via a shaft 44. Consequently, by rotating the primary gear 42, as indicated by arrow 45, the rotating compartment 34 will rotate within the box frame 32, as indicated by arrow 46. A pinion gear 48 engages the primary gear 42 at its lower most point. Consequently, any rotation of the pinion gear 48 will rotate the primary gear 42, which in turn rotates the rotating compartment 34 and therefore the basket containers 14.

Figure 2:
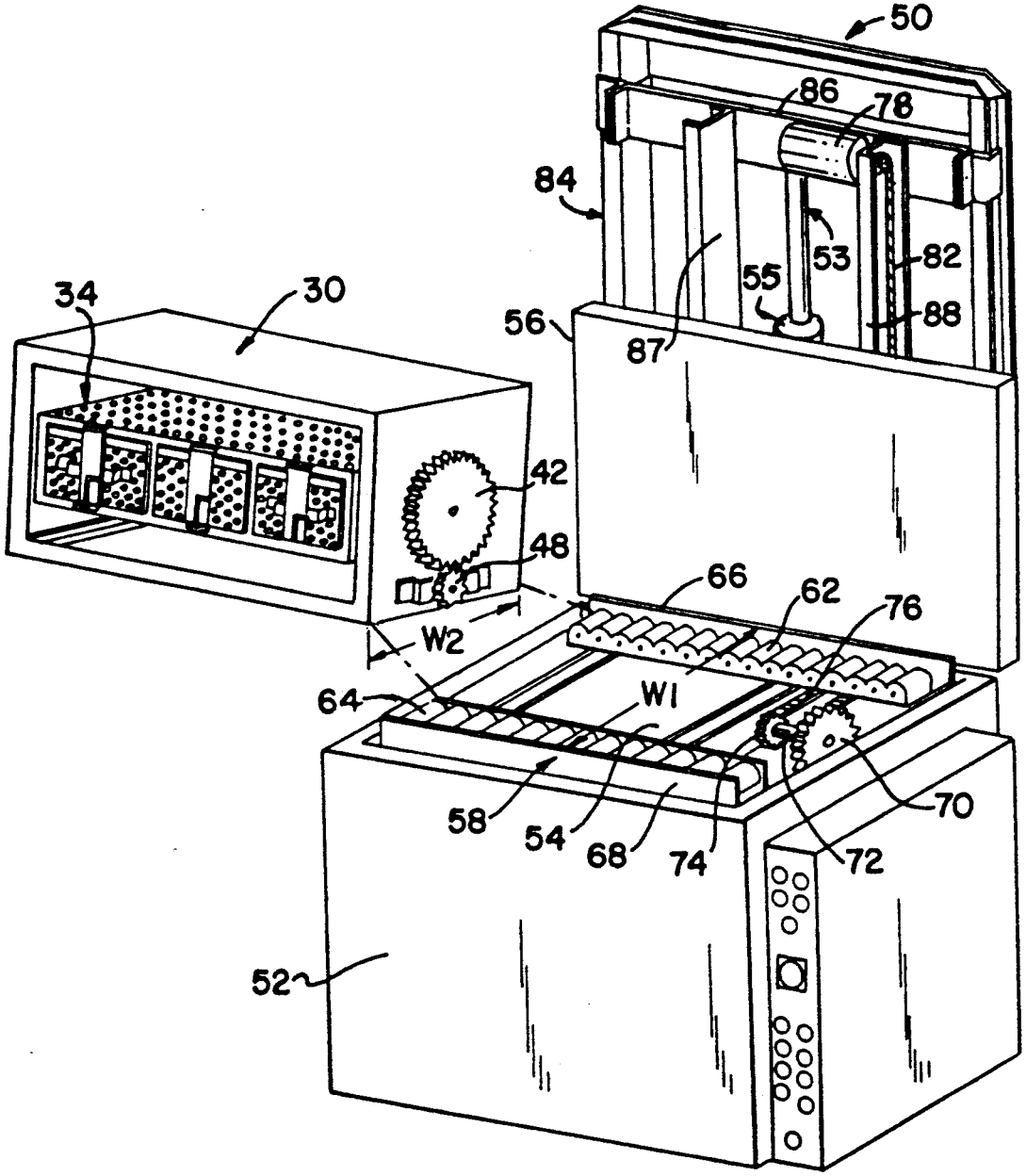
FIG. 2 is a perspective view of an immersion cleaning apparatus constructed in accordance with one preferred embodiment of the present invention and shown in conjunction with the pallet assembly of FIG. 1.

Referring to FIG. 2 there is shown a preferred embodiment of a immersion cleaning machine 50, shown in conjunction with the pallet assembly 30 of FIG. 1. In the shown embodiment, the immersion cleaning machine 50 is comprised of a tank 52, or like reservoir, which accommodates a volume of cleaning solution 54. The tank 52 has a lid 56 which may be closed over the tank 52, thereby reducing heat loss from the cleaning solution 54 and reducing evaporation of the cleaning solution 54. An elevator assembly is constructed in conjunction with the tank 52. The elevator assembly is comprised of an elevator platform 58 which is secured to two elongated support members 87, 88. A crossbar member 86 joins the two elongated support members 87, 88, on one side. The two elongated support members 87, 88 are parallel, as such the crossbar member 86 is secured to each of the support members 87, 88 at a perpendicular. An elevator guide framing 84 extends above the tank 52. The crossbar member 86 engages the elevator guide framing 84 and is reciprocally movable up and down along the structure of the elevator guide framing 84. Consequently, as the crossbar member 86 is moved up and down along the elevator guide framing 84, the elongated support members 87, 88 reciprocally move within the tank 52, raising and lowering the elevator platform 58.

A elevator drive assembly 53 engages the crossbar member 86 and controls the reciprocal movement of the crossbar member 86 along the elevator guide framing 84. The elevator drive assembly 53 can include any conventional mechanical, pneumatic and/or hydraulic elevator drive. However, in the preferred embodiment, the elevator drive assembly 53 is a pneumatic cylinder 55 secured to the center of the crossbar member 86 and operating to move the crossbar member 86 up and down the elevator guide framing 84 by the reciprocating action of the cylinder 55. The range of movement embodied by the pneumatic cylinder 55 enables the elevator platform 58 to be raised into the same plane as the open top of the tank 52. Similarly, the range of the pneumatic cylinder 55 also enables the elevator platform 58 to be lowered into the tank 52 well below the surface of the cleaning solution 54.

The elevator platform 58 includes two parallel rows of rollers 62, 64. Guide rails 66, 68 extend upwardly from the sides of the rows of rollers 62, 64 thereby defining sides of a channel having a width W1. The width W1 of the channel defined by the guide rails 66, 68 is slightly larger than the width W2 of the pallet assembly 30. Similarly, the length of the rows of the rollers 62, 64 are slightly longer than the length of the pallet assembly 30. Consequently, the pallet assembly 30 can be pushed onto, and advanced across, the rollers 62, 64, wherein the guide rails 66, 68 will guide the orientation of the pallet assembly 30 and enable the pallet assembly 30 properly aligns above tank 52.

A drive gear 70 is formed as part of the elevator platform 58 and is positioned between the rows of rollers 62, 64 at the far right end of the elevator platform 58. The drive gear 70 extends above the plane of the rows of rollers 62, 64. As such, when the rows of rollers 62, 64 are elevated into the same plane as the top of the tank 52, the drive gear 70 extends above the top of the tank 52. The drive gear 70 is secured to a solid shaft 72. A sprocket 74 is also secured to the shaft 72. A first drive chain 76 engages the sprocket 74 coupling the sprocket 74 to a gearing assembly 75. The gearing assembly 75 is driven by the drive motor 78 which is coupled to the gearing assembly 75 by a second drive chain 82. The drive gear 70 is rotated by activating the drive motor 78, wherein the drive motor 78 moves the second drive chain 82 which drives the first drive change 76, via the gearing assembly 75. The first drive chain 76 turns the sprocket 74 on the shaft 72, which in turn drives the drive gear 70.

The drive motor 78 and other elements that drive the drive gear 70 are also joined to either the support members 87, 88 or the elevator platform 58. Consequently, the elevator platform 58, support members 87, 88 and the various components that drive the drive gear 70 all ascend and descend together as the crossbar member 86 is reciprocated by the pneumatic cylinder 55. Since all the elements that drive the drive gear 70 ascend and descend together, the drive gear 70 can be rotated by the drive motor 78 regardless to the vertical position of the drive gear 70 within the tank 52.

Figure 3:
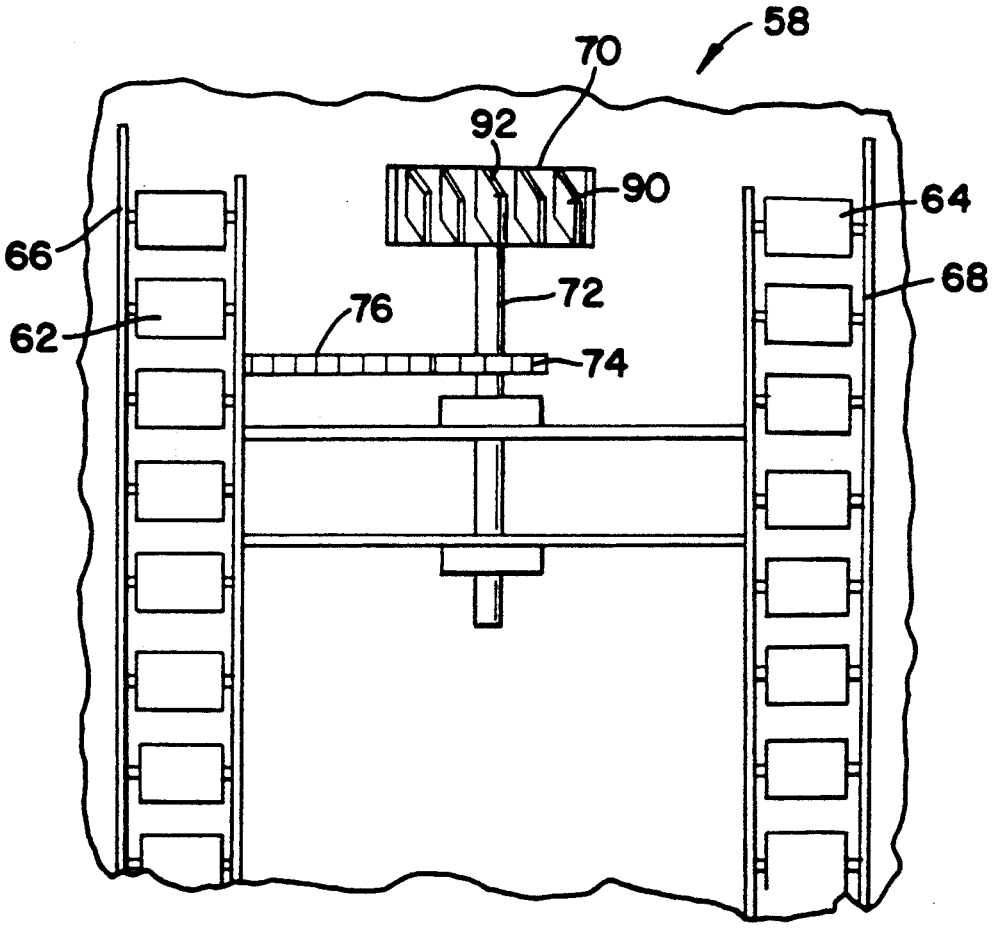
FIG. 3 is a top segmented view of the drive gear present on the elevator platform of the immersion cleaning apparatus of FIG. 2.

As the pallet assembly 30 is pushed across the rows of rollers 62, 64 on the elevator platform 58, the guide rails 66, 68 orient the pallet assembly 30 and enables the pinion gear 48 on the pallet assembly 30 to mesh with the drive gear 70 on the elevator platform 58. Referring to FIG. 3, a top view of the drive gear 70 is shown wherein the taper of the drive gear teeth 90 can be shown. Each of the gear teeth 90 have a sloped face surface 92 embodying an angle of inclination of approximately twenty degrees. The teeth on the pinion gear 48, disposed on the pallet assembly 30, are similarly sloped. The slope of the drive gear teeth 90 and the pinion gear teeth allow the drive gear 70 and the pinion gear 48 to mesh, as the pallet assembly 30 is pushed along the rows of rollers 62, 64. Consequently, the drive gear 70 is automatically coupled to the pinion gear 48 of the pallet assembly 30 as the pallet assembly 30 is fully advanced onto the rows of rollers 62, 64.

Figure 4:
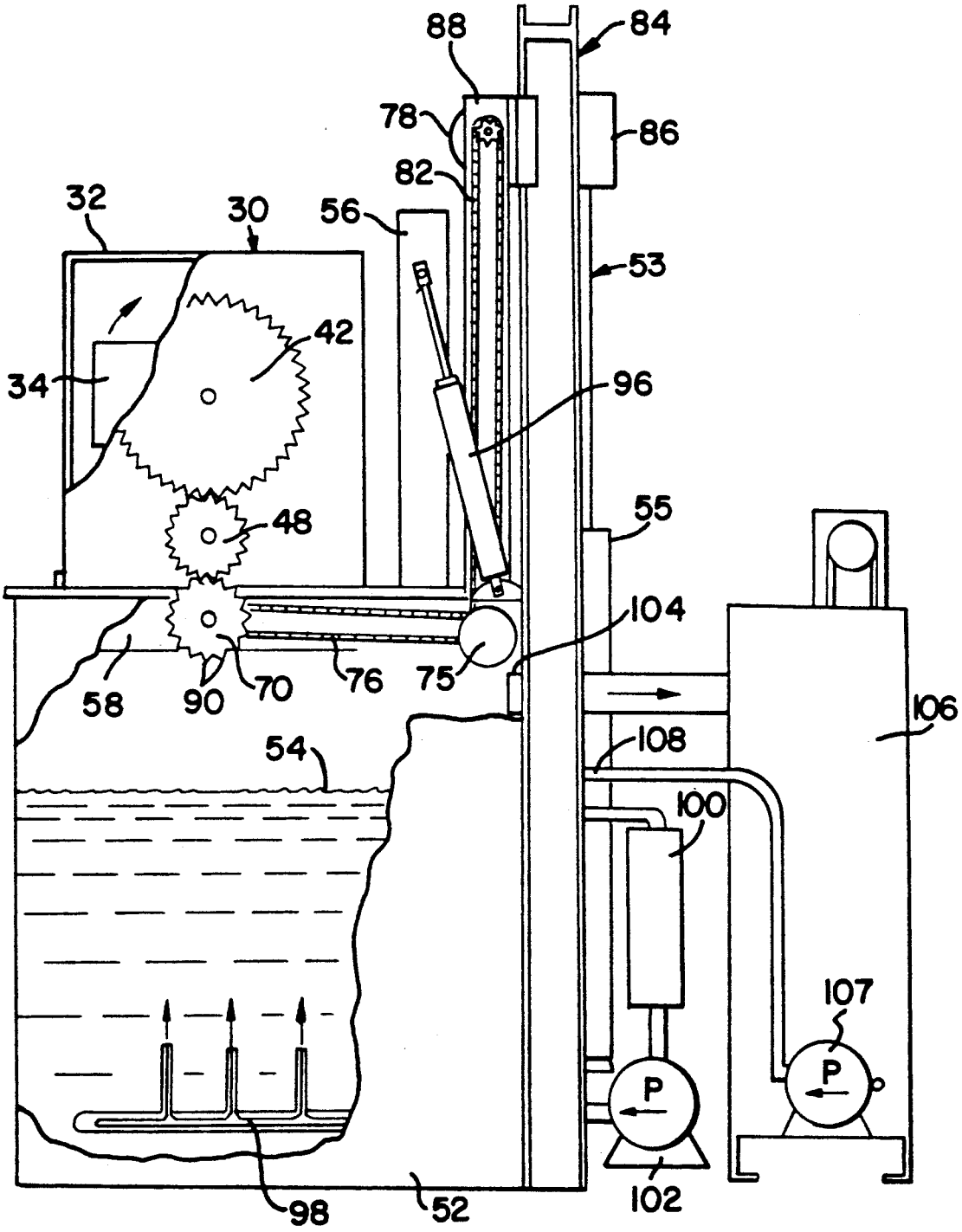
FIG. 4 is a side view of the immersion cleaning apparatus of FIG. 2 shown in conjunction with the pallet assembly of FIG. 1. Surface components in selected areas are removed to show internal workings and facilitate consideration and discussion.

Referring to FIG. 4, the pallet assembly 30 is shown in position on top of the elevator platform 58 so that the pinion gear 48 of the pallet assembly 30 meshes with the drive gear 70. Once meshed, any rotation of the drive gear 70 is directly transferred to the pinion gear 48. As has been previously explained, the pinion gear 48 turns the primary gear 42 which turns the rotating compartment 34 within the box frame 32 of the pallet assembly 30. Once the pallet assembly 30 is properly positioned on the elevator platform 58, the rotating compartment 34 can be rotated within the box frame 32 by the activation of the drive motor 78.

As the pallet assembly 30 is placed onto the elevator platform 58, the lid 56 of the tank 52 is open. Furthermore, the elevator platform 58, support members 87, 88 and crossbar member 86 are at their highest elevated point, and are ready to descend in order to immerse the pallet assembly 30 into the tank 52. As will be later explained, the lid 56 is automatically controlled and is manipulated by the use of a lift cylinder 96. Within the tank 52 is a predetermined volume of cleaning solution 54. At the bottom of the tank is positioned a jet manifold 98 used to recirculate the cleaning solution 54 in a turbulent fashion within the tank 52. Cleaning solution 54 is drawn from the tank 52 and through a filter 100 by a pump 102. The pump 102 then returns the filtered cleaning solution back into the tank 52 through the jet manifold 98. The cleaning solution exits the jet manifold 98 under pressure, thereby causing a turbulent flow of the cleaning solution 54.

A drain orifice 104 is positioned at a predetermined height within the tank 52. The drain orifice 104 leads to a oil removing assembly 106 capable of removing oil and other buoyant contaminants from an aqueous solution. Cleaning solution 54 is drawn through the oil removing assembly 106 by a second pump 107 which expels the cleaning solution 54 back into the tank 52 through a discharge line 108. The expelled cleaning solution causes the cleaning solution 54 to overflow into the drain orifice 104, thereby removing buoyant contaminants with a sweeping action. Oil removing assemblies capable of removing oil from an aqueous solution are well known in the art. Any such known oil removing assembly can be used in conjunction with the present invention and the operation of such oil removing assemblies need not be discussed herein at length.

Figure 5:
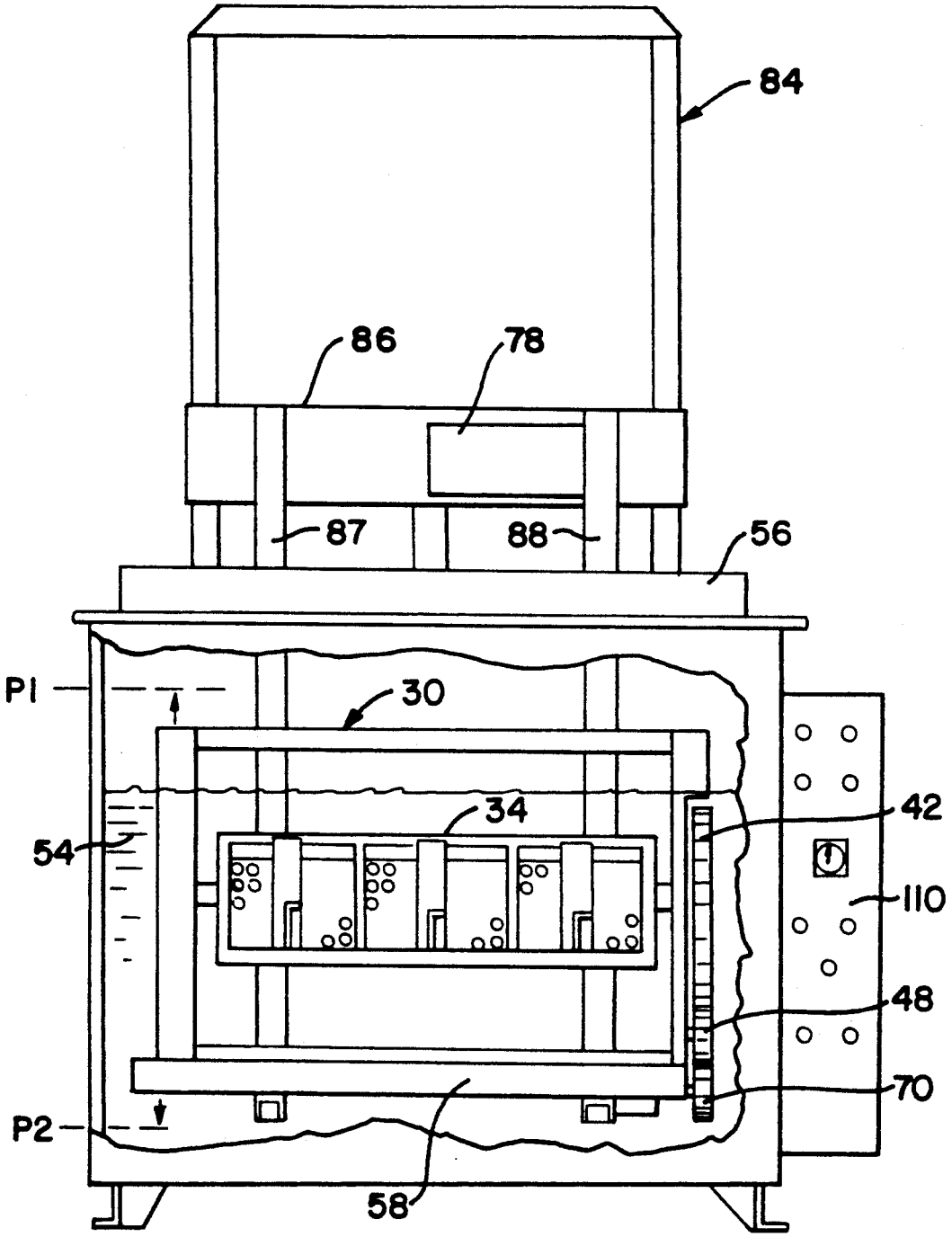
FIG. 5 is a front view of the pallet assembly of FIG. 1 positioned within the immersion cleaning apparatus of FIG. 2. Surface components in selected areas are removed to show internal workings.

Referring to FIG. 5, the pallet assembly 30 is shown within the tank 52. To lower the pallet assembly 30 into the tank 52, the elevator platform 58, support member 87, 88 are lowered into the tank 52 by lowering the position of the crossbar member 86 on the elevator guide framing 84. Once lowered to a proper depth, the lid 56 is closed by the lid lift cylinders 96 and the pallet assembly 30 is sealed within the tank 52. For the reasons to be later explained, the pallet assembly 30 is reciprocally cycled up and down within the tank 52 by the elevator platform 58 from an uppermost cycle point P1 to a lowermost cycle point P2. The level of the cleaning solution 54 in the tank 52 is maintained at a depth that allows part of the rotating compartment 34 within the pallet assembly 30 to rise above the level of the cleaning solution 54 when the pallet assembly 30 is cycled to its uppermost cycle point P1.

The operation of the entire cleaning system is governed by the control unit 110. The control unit 110 may include a programmable microprocessor or may utilize analog timers, buttons, switches and the like to control various operations and cycle times. Referring to FIGS. 1 through 5 in combination it can be seen that the present invention immersion cleaner apparatus works by first loading manufactured parts 12 into the various basket containers 14. The covers 16 of the basket containers 14 are then set into position in the manner previously described to provide support to the manufactured parts 12 during rotation. The filled basket containers 14 are then loaded into the rotating compartment 34 of the pallet assembly 30 as previously described, and secured into place.

The loaded pallet assembly 30 is then rolled onto the elevator platform of the immersion cleaning machine 50. The pallet assembly 30 rolls along the rolls of rollers 62, 64, guided by the guide rails 66, 68 until the pinion gear 48 of the pallet assembly 30 meshes with the drive gear 70. Once the pallet assembly 30 is properly positioned, the drive motor 78 is activated. The drive motor 78 turns the drive gear 70 in the manner previously described. The drive gear 70 drives the pinion gear 48, on the pallet assembly 30, which in turn drives the primary gear 42. The primary gear 42 causes the rotating compartment 34 within the box frame 32 of the pallet assembly 30 to start turning. The speed of the drive motor 78 is variable. As such, the rotating compartment 42 can be rotated at any desired speed within the range of the drive motor 78.

With the rotating compartment 42 rotating within the pallet assembly 30, the elevator platform 58 descends and the pallet assembly 30 is lowered into the tank 52. Once within the tank 52, the lid 56 of the tank 52 automatically closes, sealing the pallet assembly 30 within the tank 52. The pallet assembly 30 is then reciprocally cycled up and down within the tank 52 by the vertical reciprocal movement of the elevator platform 58 between high cycle point P1 and low cycle point P2. Consequently, the basket containers 14 within the pallet assembly 30 are being rotated by the rotating compartment 34 and vertically displaced by the elevator platform 58, simultaneously. The height of the stroke, as well as the number of strokes per minute are all selectively controlled by control unit 110. Due to the level of the cleaning solution 54 within the tank 52 and reciprocating and rotating movement of the basket containers 14, the manufactured parts 12 within the basket container 14 are repeatedly being submerged within, and again brought above, the cleaning solution 54.

By repeatedly immersing the manufactured parts 12 into the cleaning solution 52, cleaning solution 52 is allowed to repeatedly drain from any blind holes, depressions or grooves that may harbor contaminants or debris within the manufactured parts 12. The action of fluid draining from such contours helps remove the contaminants and debris from those locations. Additionally, due to the reciprocal and rotating movements of the basket containers 14, the orientation of the retained machine parts 12 constantly changes, thereby more effectively cleaning each of the machine parts 12.

It is during the washing cycle of the immersion cleaning machine 50 that the basket containers are being both rotated and reciprocally displaced. It is also during this washing cycle that the first pump 102 is activated and the cleaning solution is being drawn through the filter 100 and expelled back into the tank 52 through jet manifold 98. The turbulent agitation of the cleaning solution produced by the jet manifold 98, the reciprocal movement of the elevator platform 58 and the rotational movement of the rotating compartment 34, provides all the agitation needed to clean the manufactured parts 12.

After a desired wash cycle has been completed, the first pump 102 is stopped, as is the reciprocal and rotational movement of the basket containers 14. When the wash cycle is completed, the basket containers 14 are stopped at a position that is completely immersed below the surface of the cleaning solution 54. As such, each of the manufactured parts 12 retained within each basket container 14 is immersed below the surface of the cleaning solution 54. The manufactured parts 12 are then held at rest below the level of the cleaning solution 54 for a predetermined dwell time so that oil based contaminants, and other buoyant contaminants, within the cleaning solution 54 are permitted to raise to the surface of the cleaning solution 54.

At the end of the dwell time, wherein the oil based contaminants have floated to the surface of the cleaning solution, the second pump 107 is activated and the oil removal cycle is begun. As the second pump 107 is activated, the surface layer of the cleaning solution, including any floating contaminants in that layer are drawn through the drain orifice 104 into the oil removing assembly 106. Oil based contaminants are removed from the cleaning solution and the cleaning solution is returned to the tank 52 through the return line 108. Once the oil contaminants have been removed, the lid lift cylinders 96 are activated and the lid 56 of the tank 52 is raised. The drive motor 78 is again activated so that the rotating compartment 34 retaining the basket containers 14 again begins to rotate within the pallet assembly 30. As the rotating compartment 34 is rotating, the elevator platform 58 raises the pallet assembly 30 out of the cleaning solution. The rotating of the rotating compartment 34 allows fluid to fully drain from the manufactured parts 12 in the basket containers 14, despite any blind holes or depressions that may retain fluid in the manufactured parts 12. Once the elevator platform 58 is fully raised, the drive motor 78 is stopped and the rotating compartment 34 stops rotating. The movement of the elevator platform 58 and the rotation of the rotating compartment 54 can be controlled via a push button or automatically stopped via a programmable controller. If the rotating compartment 34 is not properly oriented for the easy removal of the basket containers 14, the drive motor 78 can be stepped forward until the rotating compartment 34 is in a desired orientation. The pallet assembly 30 is then removed from the immersion cleaning machine 50 without having to unload the basket containers 14. Similarly a new pallet assembly, already prefilled with other contaminated parts, can be quickly loaded into the immersion cleaning machine 50. This palletized system allows for the quick loading and unloading of the immersion cleaning machine 50, thereby reducing downtime.

Figure 6:
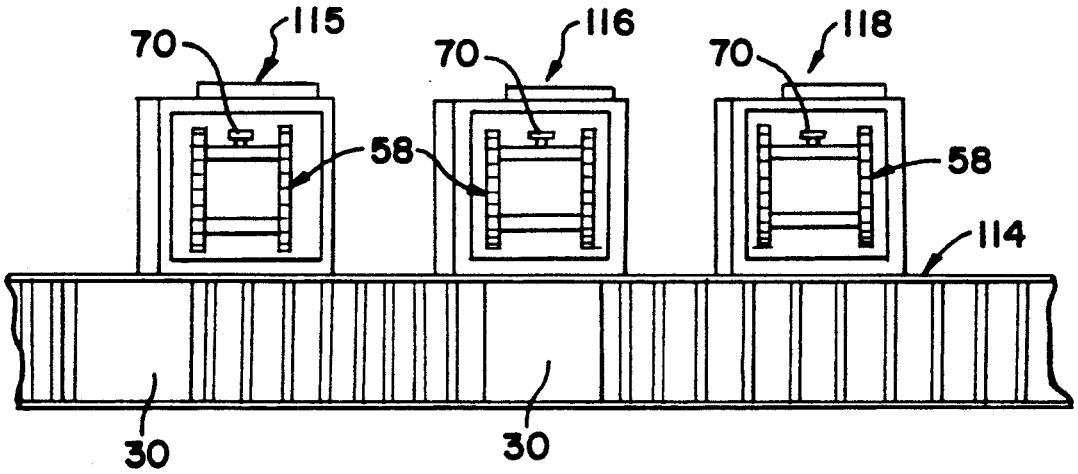
FIG. 6 is a perspective view of a modular system comprising a plurality of machines in series, across which the pallet assembly of FIG. 1 can be processed.

When cleaning manufactured parts, the parts may require different cleaning procedures in different machines. For example, parts may be cleaned in one machine, rinsed in another and finally dried in a third machine. Referring to FIG. 6, there is shown a series of different machines joined by a common roller conveyor 114. For the purposes of example, the first machine 115 may be a immersion cleaning machine such as the machine previously described. The second machine 116 may be used to rinse the parts after being cleaned in the immersion cleaning machine 115. The third machine 118 may be used to dry the machine parts after they are removed from the second machine 116. Each of the machines 115, 116, 118 has an elevator platform 58 such as that previously described. Similarly, each of the machines has a drive gear 70, as has been previously described, that automatically engages and rotates the rotating compartment 34 within the pallet assembly 30 as the pallet assembly 30 is loaded into each of the machines 115, 116, 118. By joining each of the machines 115, 116, 118 with a roller conveyor 114, it can be seen that the pallet assembly 30 can be moved from one machine to another without having to unload the basket containers 14 from the pallet assembly 30. Consequently, a palletize system is created wherein the manufactured parts 12 to be cleaned are loaded into pallet assemblies 30 at the beginning of an operation. The pallet assemblies 30 can then be advanced along the roller conveyor 114 from one machine to another until a desired processing sequence is completed. The manufactured parts 12 are then unloaded from the pallet assemblies 30 ready for the next manufacturing process step or packing. In the present invention system, each of the machines 115, 116, 118 along the roller conveyor 114 includes a drive gear 70 that engages the pallet assemblies 30 enabling the rotating compartments 34 to rotate within the pallet assemblies 30. Although three machines 115, 116, 118 are shown in FIG. 6, any number of machines may be used and any modular system built to preform other desired operations. For instance, other machines can be added to the roller conveyor 114 that chemically surface treat the parts being cleaned or preform many other desired operations.

It will be understood that the present invention immersion cleaning apparatus and system described herein are merely exemplary and that a person skilled in the art may make many variations and modifications to the described embodiments utilizing functionally equivalent components to those described. All such variations and modifications are intended to be included within the scope of this invention as defined by the appended claims.

What is claimed is:

1. An apparatus for immersing at least one object in a fluid, comprising:

a transportable pallet having at least one rotatable receptacle disposed therein, in which said at least one object can be retained;

reservoir means capable of retaining a volume of fluid into which said transportable pallet can be completely immersed;

reciprocating means for vertically reciprocating said transportable pallet within said reservoir means; and drive means, disposed on said reciprocating means for engaging and rotating said rotatable receptacle within said pallet, said drive means moving vertically with said reciprocating means whereby said drive means can engage and rotate said rotatable receptacle in said transportable pallet, while on said reciprocating means, regardless to the vertical position of said reciprocating means in said reservoir means.

2. The apparatus according to claim 1, further including a cover for said reservoir means, wherein said cover can be closed over said reservoir means, enclosing said transportable pallet in said reservoir means as said transportable pallet is reciprocated by said reciprocating means and said rotatable receptacle is rotated by said drive means.

3. The apparatus according to claim 1, further including guide means positioned on said reciprocating means for guiding said transportable pallet into a set position on said reciprocating means, said drive means engaging said rotatable receptacle in said transportable pallet when said transportable pallet is in said set position.

4. The apparatus according to claim 3, wherein said transportable pallet includes a gearing arrangement used to rotate said rotatable receptacle, and said drive means includes a drive gear disposed on said reciprocating means, whereby said gearing arrangement meshes with said drive means when said pallet assembly at said set position on said reciprocating means.

5. The apparatus according to claim 4, wherein said drive gear engages a pinion gear in said gearing arrangement and wherein said drive gear and said pinion gear have tapered gear teeth so that said pinion gear can mesh with said drive gear without alignment as said transportable pallet is advanced onto said reciprocating means.

6. The apparatus according to claim 1, further including at least one basket container for retaining said at least one object, wherein said at least one basket container is removably positionable within said rotatable receptacle.

7. The apparatus according to claim 1, wherein said reciprocating means includes an elevator platform that can vertically move up and down within said reservoir means.

8. The apparatus according to claim 7, wherein said drive means is affixed to said elevator platform and moves vertically with said elevator platform, whereby said drive means can engage and rotate said rotatable receptacle in said transportable pallet, while on said elevator platform, regardless to the vertical position of said elevator platform in said reservoir means.

9. The apparatus according to claim 8, wherein rollers are disposed on said elevator platform across which said transportable pallet can easily roll, and guide rails are disposed on said elevator platform to guide said transportable pallet along said rollers into a set position, wherein said rotating receptacle of said transportable pallet engages said drive means at said set position.

10. The apparatus according to claim 1, further including a control means for selectively controlling said reciprocating means and said drive means.

11. The apparatus according to claim 1 further including a circulating means for circulating said fluid in said reservoir means in a turbulent fashion, wherein said circulating means includes a filter for filtering said fluid.

12. An immersion cleaning apparatus for cleaning at least one object within a cleaning solution, comprising:

a tank for retaining a desired volume of said cleaning solution;

a transportable receptacle means for retaining said at least one object, wherein said receptacle means is selectively positionable within said tank, said receptacle means including at least one removable container, whereby said at least one object can be retained within each said container and each said container can be selectively placed within and removed from, said receptacle means;

reciprocating means, contained within said tank, for vertically reciprocating said receptacle means within said tank; and rotating means, contained within said tank, for rotating said receptacle means within said tank.

13. The apparatus of claim 12, wherein said at least one removable container is adjustable and can be adjusted in size to securely retain said at least one object held therein.

14. The apparatus according to claim 12, wherein said receptacle means includes an outer frame and at least one compartment pivotable coupled within said frame, so as to be rotatable about a common axis within said frame, whereby said at least one removable container are selectively positionable within said at least one compartment and rotate with said at least one compartment about said common axis.

15. The apparatus according to claim 12, wherein said reciprocating means includes an elevator platform within said tank, said transportable receptacle means being selectively positionable upon said elevator platform, wherein said elevator platform selectively varies the vertical position of said receptacle means within said tank.

16. The apparatus according to claim 15, wherein said rotating means is coupled to said elevator platform and vertically reciprocates with said elevator platform, whereby said rotating means selectively rotates said receptacle means while said receptacle means is being vertically displaced by said elevator platform.

17. The apparatus according to claim 12, further including a filter means for filtering said cleaning solution within said tank.

18. The apparatus according to claim 12, further including a surface skimming means for removing buoyant contaminants from the surface of said cleaning solution within said tank.

19. The apparatus according to claim 12, further including a turbulent flow means for causing the turbulent flow of said cleaning solution within said tank.

* * * * *